US005152399A

United States Patent [19]

Keenaghan et al.

[11] Patent Number: 5,152,399

[45] Date of Patent: Oct. 6, 1992

[54] KEY RING TOKEN DISPENSER

[76] Inventors: Patrick Keenaghan, 547 Vancourtland Park Ave., Yonkers, N.Y. 10705; George Spector, 233 Broadway Rm. 702, New York, N.Y. 10279

[21] Appl. No.: 736,425

[22] Filed: Jul. 26, 1991

[51] Int. Cl.[5] ..... B65D 85/58; G07D 9/06

[52] U.S. Cl. ..... 206/0.810; 206/38.1; 453/54

[58] Field of Search ..... 206/0.8, 0.81, 37.1, 206/37.4, 37.8, 38, 38.1; 70/430, 456 R; 453/54

[56] References Cited

U.S. PATENT DOCUMENTS 2,486,180 10/1949 Lane et al. ..... 70/456 R 3,389,710 6/1968 Ishikawa ..... 453/54

FOREIGN PATENT DOCUMENTS 0273402 7/1927 United Kingdom ..... 453/54

0908455 10/1962 United Kingdom ..... 206/0.81

2171830 9/1986 United Kingdom ..... 453/54

*Primary Examiner*—Jimmy G. Foster

[57] ABSTRACT

An improved key and coin holder is provided and consists of a housing for holding a plurality of coins therein, a mechanism within the housing for readily positioning the coins in a stacked relationship so that the coins can be dispensed from the housing one at a time and a chain having one end attached within the housing to the readily positioning mechanism so that the other end of the chain can engage with a key.

2 Claims, 1 Drawing Sheet

KEY RING TOKEN DISPENSER

BACKGROUND OF THE INVENTION

The instant invention relates generally to coin containers and more specifically it relates to an improved key and coin holder which provides ease of portability and dispensing of coins therefrom.

There are available various conventional coin containers which do not provide the novel improvements of the invention herein disclosed.

SUMMARY OF THE INVENTION

A primary object of the present invention is to provide an improved key and coin holder that will overcome the shortcomings of the prior art devices.

Another object is to provide an improved key and coin holder that will retain a plurality of coins within a housing which are readily positioned in a stacked relationship to be dispensed one at a time therefrom.

An additional object is to provide an improved key and coin holder in which the key is fastened by a chain to a spring biased platform within the housing which bears against the bottom coin when in the stacked relationship within the housing.

A further object is to provide and improved key and coin holder that is simple and easy to use.

A still further object is to provide an improved key and coin holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
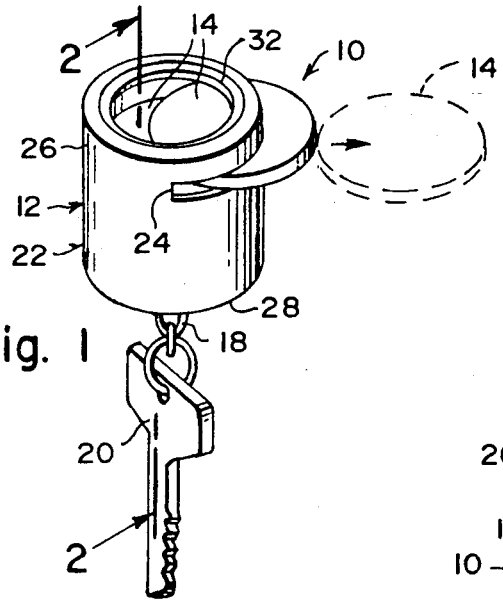
FIG. 1 is a perspective view of the instant invention.
Figure 2:
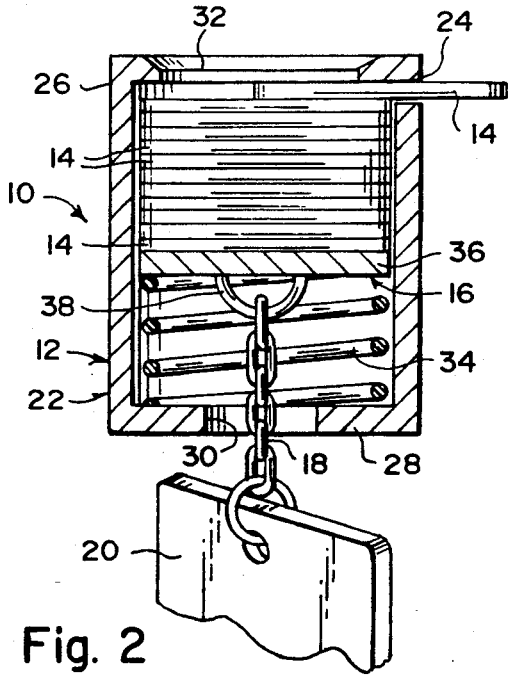
FIG. 2 is a cross sectional view taken along line 2—2 in FIG. 1.

Turning now descriptively to the drawings, in which similar reference characters denote similar elements throughout the several views, the Figures illustrate an improved key and coin holder 10 which consists of a housing 12 for holding a plurality of coins 14 therein. A mechanism 16 is within the housing 12, for readily positioning the coins 14 in a stacked relationship so that the coins 14 can be dispensed from the housing 12 one at a time. A chain 18 has one end attached within the housing 12 to the readily positioning mechanism 16 so that the other end of the chain 18 can engage with a key 20.

The housing 12 further includes a cylindrical side wall 22 having a slot 24 proximate its open top end 26 so that one coin 14 at a time can enter into and exit from the slot 24. A bottom wall 28 has a central aperture 30 therethrough so that the chain 18 can extend through the central aperture 30. An annular stop flange 32 is in the top end 26 of the side wall 22 to retain the top coin 14 of the stacked coins 14.

The readily positioning mechanism 16 includes a compression coil spring 34 within the cylindrical side wall 22 on the bottom wall 28. A disc-shaped platform 36 sits upon the compression coil spring 34 and bears against the bottom coin 14 of the stacked coins 14. A C-shaped loop member 38 is affixed to the bottom of the disc-shaped platform 36 so that the one end of the chain 18 can be attached to the C-shaped loop member 38.

Figure 3:
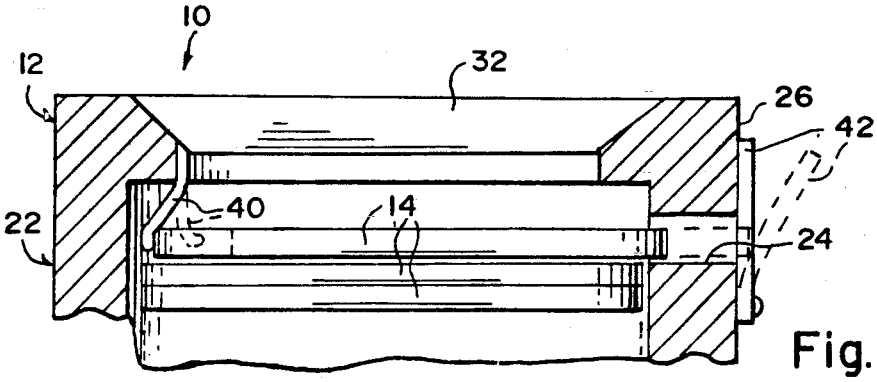
FIG. 3 is an enlarged cross sectional view of the upper portion of the casing showing a modification in which two springs are utilized to assist in allowing the top coin to exit through the slot.

As shown in FIG. 3, the housing 12 further includes a first leaf spring 40 affixed internally to and extends downwardly from the annular stop flange 32 opposite from the slot 24 so as to help guide the top coin 14 of the stacked coins 14 into the slot 24 in the cylindrical side wall 22. A second left spring 42 is pivotally affixed externally to and normally extends upwardly from the cylindrical side wall 22 to cover the slot 24 so as to prevent the accidental dislodgement of the top coin 14 through the slot 24.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved key and coin holder which comprises:

a) housing for holding a plurality of coins therein;

b) means within said housing, for readily positioning the coins in a stacked relationship so that the coins can be dispensed from said housing one at a time; and c) a chain having one end attached within said housing to said readily positioning means so that other end of said chain can engage with a key; wherein said housing further includes:

d) a cylindrical side wall having a slot proximate its open top end so that one coin, at a time can enter into and exit from the slot;

e) a bottom wall having a central aperture therethrough so that said chain can extend through the central aperture; and f) an annular stop flange in the top end of said side wall to retain the top coin of the stacked coins; wherein said readily positioning means includes:

g) a compression coil spring within said cylindrical side wall on said bottom wall; and h) a disc-shaped platform to sit upon said compression coil spring and bear against the bottom coin of the stacked coins; and i) a C-shaped loop member affixed to the bottom of said disc-shaped platform so that the one end of said chain can be attached to said C-shaped loop member.

2. An improved key and coin holder as recited in claim 1 wherein said housing further includes:

a) a first leaf spring affixed internally to and extending downwardly from said annular stop flange opposite from the slot so as to help guide the top coin of the stacked coins into the slot in the cylindrical side wall; and b) a second leaf spring pivotally affixed externally to and normally extend upwardly from said cylindrical side wall to cover the slot so as to prevent the accidental dislodgement of the top coin through the slot.

* * * * *